United States Patent [19]

McDonald et al.

[11] 4,055,455

[45] Oct. 25, 1977

[54] APPARATUS FOR LINING AND TESTING CONTAINER CLOSURES

[75] Inventors: Walter McDonald, Landing; Norbert F. Seitel, Gillette; Richard A. Burger, Pompton Lakes, all of N.J.

[73] Assignee: Norwalt Design, Inc., Whippany, N.J.

[21] Appl. No.: 708,691

[22] Filed: July 26, 1976

[51] Int. Cl.[2] ..... B65C 9/40; G01M 3/32

[52] U.S. Cl. ..... 156/351; 73/45.1; 73/150 A; 156/363; 156/378; 156/379; 156/521; 156/557; 156/578

[58] Field of Search ..... 156/352, 363, 378, 379, 156/423, 512, 521, 528, 557, 578, 351; 425/135, 139, 140; 53/53, 78; 73/52, 45, 45.1, 45.2, 45.4, 150 A; 198/436, 440, 645; 83/73, 209, 249, 279, 280; 221/93, 206, 252

[56] References Cited

U.S. PATENT DOCUMENTS

| | | | |
|---|---|---|---|
| 2,567,141 | 9/1951 | Andrew et al. | 156/521 |
| 2,719,564 | 10/1955 | Schnieder | 156/521 |
| 2,999,531 | 9/1961 | Acton | 156/521 |
| 3,117,441 | 1/1964 | Zimmerman | 53/78 |
| 3,369,392 | 2/1968 | Christenson | 73/45.2 |
| 3,482,372 | 12/1968 | Hottendorf | 221/93 |
| 3,591,944 | 7/1971 | Wilcox | 53/78 |
| 3,724,655 | 4/1973 | Clark | 73/45.1 |

*Primary Examiner*—Charles E. Van Horn
*Assistant Examiner*—Jerome W. Massie
*Attorney, Agent, or Firm*—Stefan J. Klauber

[57] ABSTRACT

Apparatus is disclosed for lining container closures with seals, and for testing the closures. The apparatus includes means for forming an infeed stream of closures and means interacting with the stream for forming closure groups. Conveyor means accept the groups and convey same to the various stations. At an initial station the shell integrity of the closures is tested; and closures are rejected at a following station if found to be the product of short molding shots or so forth. Thereafter, an adhesive is dispensed to the closure interior, and at a successive station seals are punched from a web and emplaced in the closure. A loose liner detector and removal station detects and removes loose liners from the closures. The sealing characteristics of the closures are then tested at a further station, and closures found to be imperfect are rejected; after which the closures which successfully pass through the several stations are discharged from the apparatus. Depending upon the desired application of the apparatus, certain of the foregoing stations can be omitted; or additional testing stations can be added. The apparatus is also adapted for embodiments wherein testing functions alone are performed, e. g. where so-called linerless caps are to be processed.

22 Claims, 12 Drawing Figures

APPARATUS FOR LINING AND TESTING CONTAINER CLOSURES

BACKGROUND OF INVENTION

This invention relates generally to apparatus for processing container closures and caps prior to use thereof; and, more specifically relates to apparatus for inserting liners into such closures, and for inspecting same for suitability for an intended application.

Container closures and caps manufactured, for example, of plastics or the like by such techniques as molding, are utilized with myriad products in consumer, industrial, and other applications. In the majority of present applications for these closures, they are commonly provided with an insert or liner prior to use thereof. The liner, which may comprise a slightly compressible plastic or similar material, is affixed within the cap interior, as by being adhered thereto by an adhesive composition. The liner serves an important function in assuring a proper seal with the container with which the closure is utilized.

In the past, the aforementioned liners have been inserted into the molded or other caps, by use of various apparatus. Thus in a typical prior art device a rotatable indexing table is utilized, which table is provided with a plurality of stations. Thus, at a first station the caps may be properly oriented; at a second station an adhesive material may be dispensed to the cap interior; at a third station, the liners may be emplaced and tamped, or so forth.

While apparatus of the foregoing type have, in a number of instances, been reasonably well adapted to the mentioned lining function, an ever-increasing interest has been generated in the objective of inspecting the aforementioned caps, in order to determine their true suitability for the ultimate use thereof. It may be noted in this connection that a number of serious problems are commonly encountered in closures of the aforementioned type, both in consequence of the defects in the closure shell proper, i.e. irrespective of the liner; and in the product which results from the lining operation. The shell may, for example, be the result of a "short shot" in the molding process, i.e. an insufficient quantity of plastic is provided during the molding process, resulting in voids or incompleted portions of the shell. Similarly, the liner itself can be improperly emplaced as, for example, by being cocked at an angle; or the liner may simply not be adhered in proper fashion. All of these defects, and others, can result in an ultimate product which is incapable of maintaining a proper closure for the container with which it is utilized; and such fact can, in turn, result in leakage from the container. Depending upon the nature of the contents of such container, the result can be not merely inconvenience, but possibly danger to the consumer or other individuals concerned with the container contents. Leakage can also have dire economic consequences for the manufacturer or distributor, who may be forced to discard large shipments because of damage from a limited number of leaking containers.

Finally, it may be observed that in a recent type of closure that has come into use in the container industry, liners have been eliminated by molding into the closure an internal lip, which engages with the top of the container with which the closure is utilized. Such lip effectively functions in the manner of a liner, i.e. to seal with the said container. Even in these instances, however, the various closure shell imperfections and defects that have already been alluded to, can once again be present, i. e. said closures can be the results of a short shot during the molding process, or they may, for other reasons, be cracked, damaged or so forth. Once again, in these instances, the consequences of using such closures with a container can be an inconvenience or a relative disaster — depending upon the specific application.

In accordance with the foregoing, it may be regarded as an object of the present invention, to provide apparatus which is adapted to insert liners into molded or other formed closures or caps, which apparatus is adapted, further, to inspect the said closures, both prior and subsequent to the lining operation, in order to determine the presence of defects which would prevent proper useage of the closures.

It is a further object of the present invention to provide lining and inspection apparatus of the aforementioned type, which is capable of processing large numbers of closures in rapid and virtually continuous fashion, and which rejects closures found to be defective without any requirement for shutting down the said apparatus and thereby generating lost production time.

It is a yet further object of the present invention, to provide apparatus of the foregoing type, which includes means for directly punching and emplacing cap liners from a continuous web provided to the machine; and which further, includes provision for adjusting the web feed so as to insure high utilization for the web material.

It is a still further object of the present invention, to provide apparatus of the foregoing type, which includes simple and highly effective means for adjusting the apparatus to handle a variety of closure sizes with equal facility.

It is a still additional object of the present invention, to provide apparatus which is capable of inspecting closures and caps of the linerless type, in order to determine the presence therein of defects which would impair the usefulness of same for use in container applications.

SUMMARY OF INVENTION

Now in accordance with the present invention, the foregoing objects, and others as will become apparent in the course of the ensuing specification, are achieved in apparatus including capabilities for both emplacing liners into container closures and caps, and as well a capability for testing the said caps or closures for a variety of defects which would impair the usefulness thereof.

The apparatus includes means for forming an infeed stream of closures, which thus proceed on an infeed conveyor belt. Means in the nature of an escapement mechanism, interact with the infeed stream to form closure groups consisting, e. g. of four closures or other suitable number. The groups are presented to a conveyor means which is adapted to convey closures of diverse sizes through the main processing stream of the apparatus, i. e. by indexing the closures to the various stations of the apparatus at which testing and lining is effected.

At an initial station, the integrity of the closure shells is tested, in order to determine, for example, whether the closures are cracked or are the result of short molding shots or so forth. Closures which are found to be defective in these respects are rejected from the processing stream, at a subsequent downstream station.

At a following station, adhesive is dispensed to the interior of each of the closures, which are then indexed to a liner emplacement station. At the latter, a liner web is fed through a punch and emplacement station — the angle of web feed being adjustable in order to assure maximum web utilization in accordance with the size of the liners being punched. Upon the web being thus punched, the station includes means for emplacing the individual liners in the closures. The closures may then be passed to a tamping station, where the liners are tamped into place. Nextly, the closures are presented to a loose liner detector and removal station, which detects and removes loose liners from the closures and disposes of same.

At a further downstream station, the closures are tested for sealing characteristics, and closures found to be imperfect are thereupon rejected at a further downstream rejection station. The closures which have successfully passed through each of the aforementioned stations are passed to a discharge station, where a conveyor carries the satisfactory products from the apparatus.

The present device is particularly adapted, as just indicated, to an operation wherein both lining and inspection functions are to be performed. However, it should be emphasized that the said apparatus, with the omission of certain stations associated with the lining operations, is equally well adapted to a mode of use wherein so-called "linerless" closures are processed from a testing viewpoint, i.e. in order to determine whether such closures are satisfactory for their intended use on containers. Thus in this sort of application, the basic machine configuration remains similar, except that the liner punch and emplacement station, the adhesive dispensing station and the loose liner detection and removal stations are eliminated.

BRIEF DESCRIPTION OF DRAWINGS

The invention is diagrammatically illustrated, by way of example, in the drawings appended hereto, in which:

FIG. 1 illustrates the manner in which

FIGS. 2A and 2B taken together constitute a perspective, somewhat simplified view, of a preferred form of apparatus in accordance with the present invention;

DESCRIPTION OF PREFERRED EMBODIMENT

Figure 1:
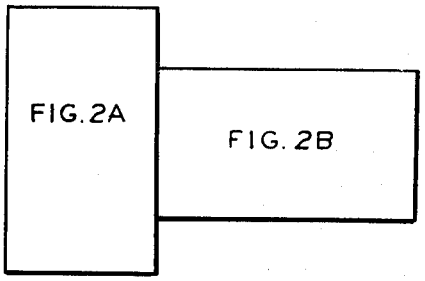
Figure 2A:
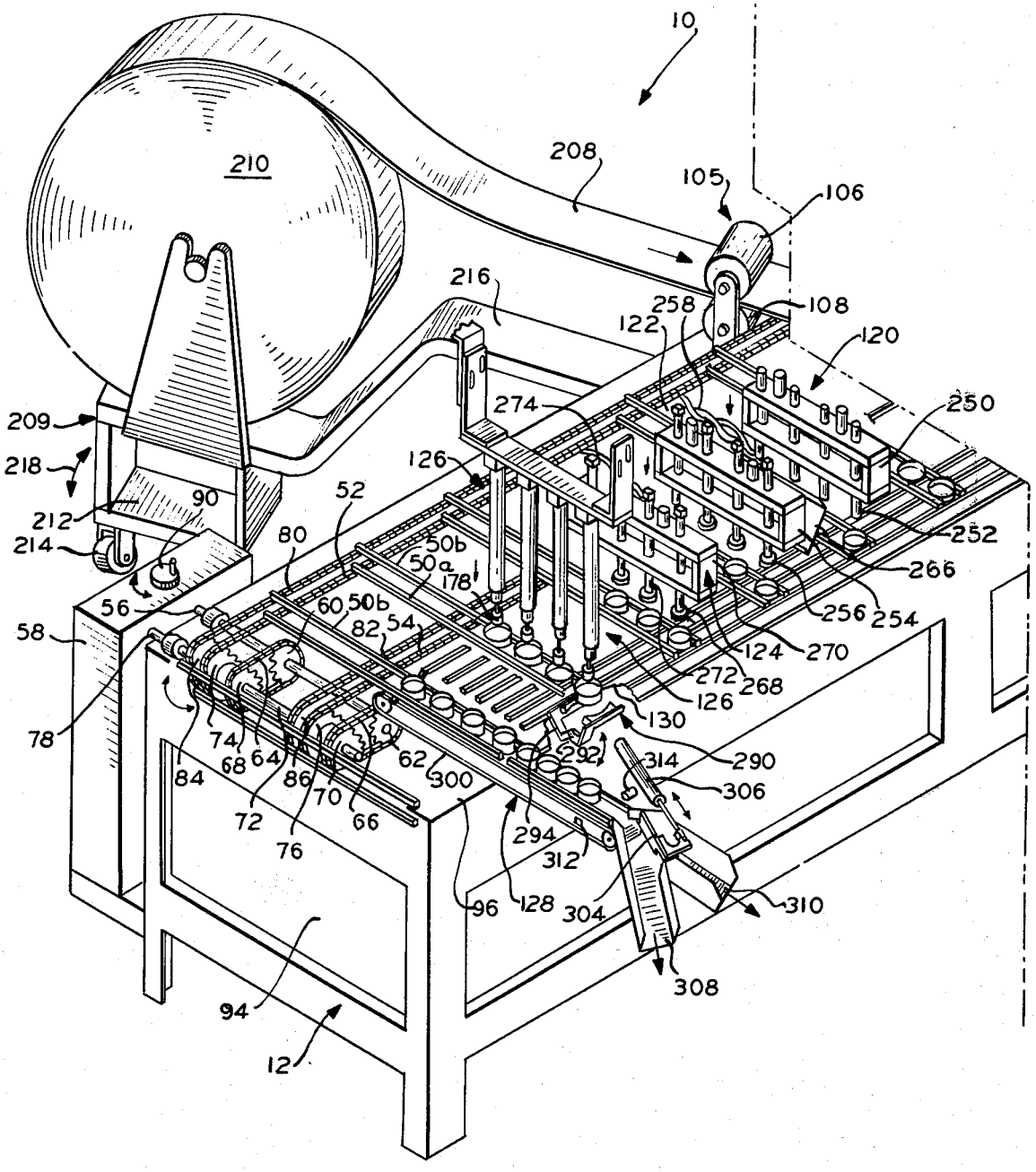
FIGS. 2A and 2B are related.
Figure 2B:
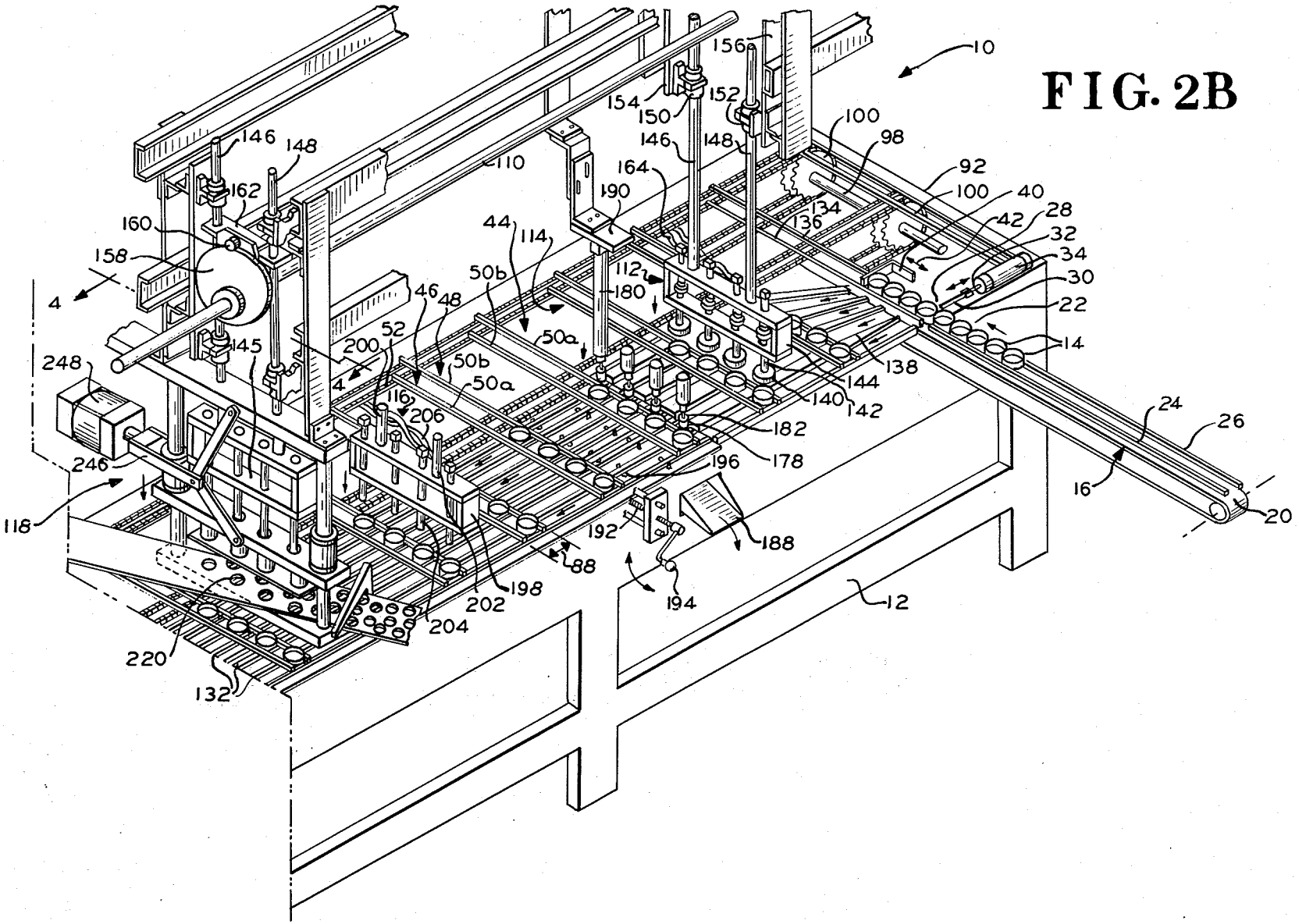
Figure 3:
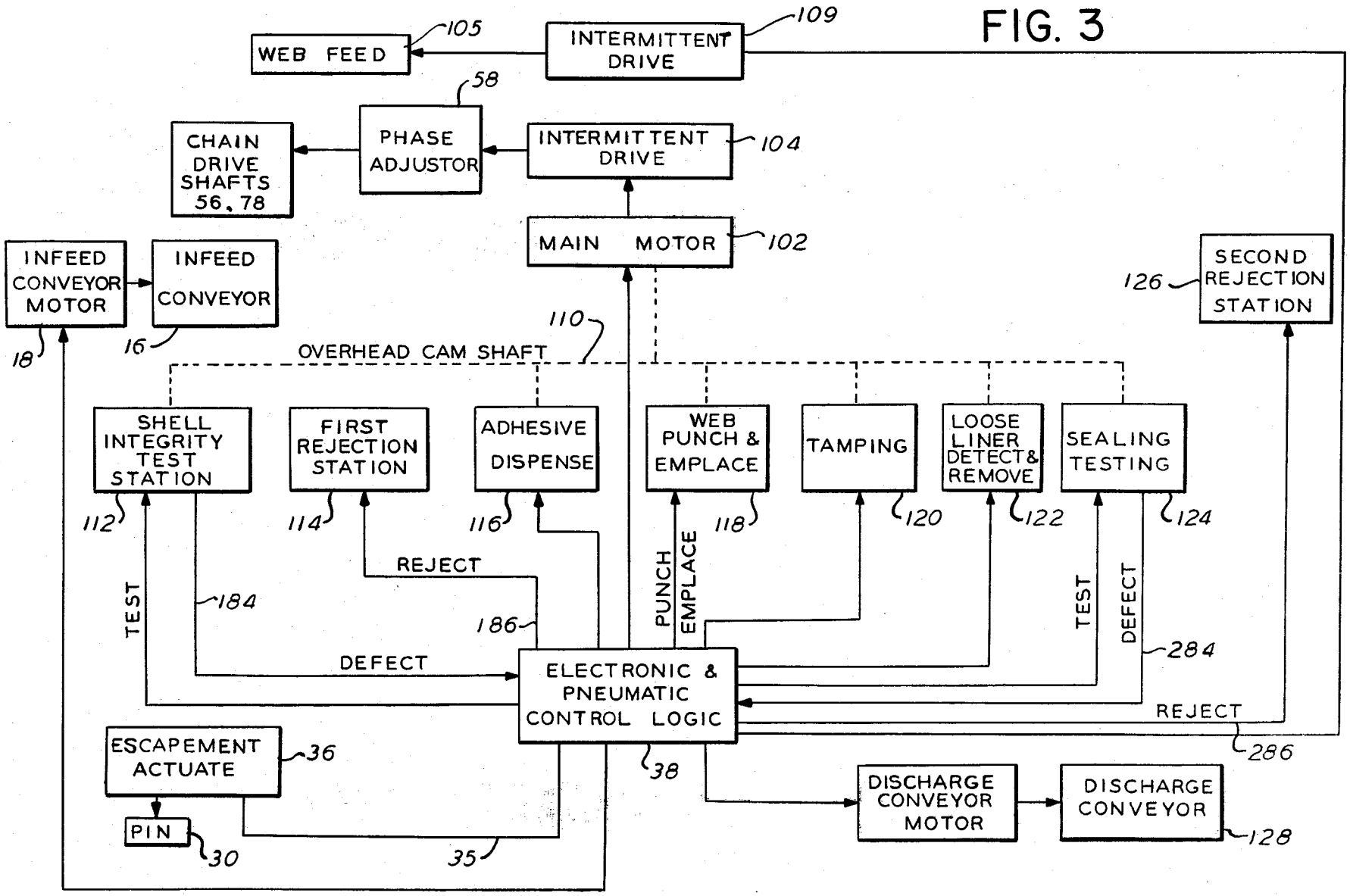
FIG. 3 is a simplified schematic block diagram, illustrating the control functions, and interaction among the various stations of the present device.

In FIGS. 2A and 2B herein, an external prospective view appears, setting forth the principal mechanical components of a closure lining and inspection apparatus 10, in accordance with the present invention. FIG. 1 may be considered simultaneously with the schematic block control diagram of FIG. 3, which will serve to better clarify the inter-relationships among the various elements of apparatus 10.

Apparatus 10 is seen to generally comprise a support frame 12, which carries the various stations which perform the lining and inspecting functions. Closures 14 which are to be processed by apparatus 10, initially enter same by a means of an infeed conveyor 16, at which a motor 18 (FIG. 3) drives a conveyor belt 20 carrying a series or stream 22 of closures 14. The stream 22 is guided along infeed conveyor 16 by a pair of guiderails 24, 26, the spacing of which may be variable to accommodate closures of different diameters.

As previously indicated, the closures 14 operated upon by the present apparatus, can constitute any of a large number of closures or caps of the type generally known in the container art. These caps are, indeed, commonly formed of plastic material, (although they can be formed of metal or other materials) and are usually provided with some type of internal threading or similar feature enabling the cap to properly engage the top of a bottle, jar or other container. As has been indicated, the apparatus shown in FIG. 1 includes stations which are particularly applicable where the said cap or closure is intended to be provided with a liner, and, in addition, is to be inspected for defects. It will be apparent, however, from what ensues, that apparatus 10 with minor modification, can be readily utilized for inspection functions alone, which may be desirable where the closures being processed are of the linerless type, i. e. are molded with features which eliminate the necessity for a liner.

The manner in which the stream 22 of closures 14 enters onto infeed conveyor 16, is not, per se, critical to the present invention; numerous devices are known in the art which are, in fact, capable of ordering a random collection of items as to present same in single file fashion to infeed conveyors or the like.

An escapement mechanism, generally indicated at 28, is seen to interact with the incoming stream 22 of closures, so as to periodically break-up the stream and thereby present a desired grouping of closures for entrance into the main processing stream of apparatus 10. Escapement mechanism 28 may consist of a pin 30, which is carried at the forward end of a piston rod 32, driven in turn by an air cylinder 34. The pin 30 is therefore capable of being periodically projected across the path of conveyance of the stream 22, so as to disrupt the flow thereof after a desired number of closures as passsed the penetration point of the pin.

Thus, in the present instance it is representatively assumed that a group of four closures 14 is to be provided for conveyance through the stations of apparatus 10. Periodic operation of the pneumatically driven piston and cylinder 34 may, as indicated in the schematic FIG. 2, be through an escapement actuate means 36 under the operation of electronic and pneumatic control logic 38. Effectively, pneumatic control pulses are thus provided to the escapement actuate means to periodically operate cylinder 34 and displace pin 30 into the infeed stream for the purpose indicated. The pneumatically actuated piston and cylinder can be replaced by other common devices. For example, the said pin can be actuated by a relay (as opposed to pneumatic actuation), in which instance the control signal proceeding via line 35 from logic 38 is purely electrical in form.

In order to enable accommodation for different cap diameters, i.e. the width of a group of closures will vary in accordance with closure diameters, a moveable stop means 40 is provided. This element is displaceable in the directions of arrow 42, by support means not seen in the Figure. Again it is assumed for purposes of concrete illustration, that a group of four closures is to be formed; and accordingly stop 40 will be displaced in one or the other direction in order to properly accommodate the total width of such group. Other sized groups of closures can be processed — i.e. by increasing the number of parallel processing lines. Indeed an important aspect of the use herein of parallel processing lines, is that a large number of closures may be processed per unit time, while at the same time the progression of individual closures is slow enough to enable desired testing.

The closure conveyor 44 utilized in apparatus 10, is seen to consist of two flights 46, 48 of conveying bars. Each bar 50*a* of the first flight 46 is secured across a pair of continuous chain carriers 52 and 54. The chain carriers 52 and 54 are driven through a drive shaft 56 which originates at a phase varying drive means 58 which will be further described in connection with FIGS. 8 and 9. Drive shaft 56, in particular, carries a pair of sprockets 60 and 62 which, acting through short drive chains 64 and 66, drive sprockets 68 and 70 which rotate on a bushing about the axis of a second drive shaft 78. Drive sprockets 74 and 76 for the chains 52 and 54 rotate with the bushing and thus are driven by sprockets 68 and 70 (and therefore by shaft 56).

The carrier bars 50*b* associated with the second flight 48, are driven through a second drive shaft 78, which is driven through the phase adjustor means 58 just referred to. The second drive shaft 78 directly drives the chains 80 and 82 for flight 48 through means of sprockets 84 and 86.

It will be seen in the Figure that the bars 50*a* on the first flight 46 are somewhat spaced from the bars 50*b* on the second flight 48, so that the spacing 88 therebetween can accommodate the diameter of the closure being conveyed through apparatus 10. Spacing 88 may actually be varied to accommodate differing diameter closures by means of an adjustment inserted via phase adjuster means 58 by means of manual control 90. This aspect of the invention will be further discussed hereinbelow; but the basic mechanism is one wherein a precise displacement of the adjacent bars with respect to a centerline therebetween is enabled.

Returning now to consideration of the forward or input end of apparatus 10, it is seen that the general mode of operation is one wherein the group of closures 14 is carried by the spaced pairs of conveying bars, from station to station in the apparatus. The conveying bars, in particular, are seen to advance from end 92 of apparatus 10 toward the opposite end 94 thereof, and upon reaching end 94 the conveying bars carried by the various continuous chains pass beneath support surface 96 and are then returned to the end 92 of the machine. In particular the continuous chains at the forward end 92 of apparatus 10 pass about an axle 98, which is provided with a plurality of sprockets 100, about which the chains pass.

The closures 14 are actually advanced in an indexed, i.e. step-wise fashion, from station to station. In particular the main drive motor 102 (FIG. 3) acts through an intermittent drive means 104 which is a geneva-type mechanism. This provides an indexed, i.e. intermittent drive, which proceeds through phase adjuster means 58; to drive chains 52, 54 and 80, 82 in indexed fashion. Main motor 102 also drives in continuous fashion an overhead cam shaft 110. A web feed means 105, consisting e.g. of web rollers 106 and 108 is driven for intermittent movement by an intermittent drive 109, which may comprise a pneumatic cylinder and a one-way clutch. The web feed rollers and overhead cam shaft control certain functions at the stations of the apparatus, as will be shortly seen.

Referring primarily to FIG. 2B, it will be seen that apparatus 10 includes generally a closure shell integrity testing station 112, a first rejection station 114, an adhesive applicator station 116, a web punch and seal emplacement station 118, a tamping station 120, a loose liner detector and removal station 122, a sealing testing station 124, a second rejection station 126, and, finally, a discharge station 128 downstream of the remaining stations — at which closures are finally discharged from the apparatus.

The various closures 14 are advanced through the several stations of apparatus 10 in overlying relationship to a dead plate 130, and proceed through a series of parallel guides 132. Initially, it will be seen that the group of closures is grasped and retained by the two bars 134 and 136 which carry the said group from infeed conveyor 16 through a plurality of spreader plates 138 which properly space the members of the group to enable appropriate positioning at the various stations.

As already mentioned, the group is initially indexed to the shell integrity testing station 112. At station 112 a plurality of test heads 140 are lowered onto the individual closures or caps and a pneumatic-type test is effected to determine shell integrity. Each of the test heads 140 is mounted at the end of an air conduit 142. The conduits, in turn, are carried by a yoke assembly 144, which depends from a pair of members 146 and 148. The latter are slideable within bearings 150 and 152, which are, in turn, secured to overhead frame members 154 and 156.

The entire test assembly consisting of yoke assembly 144 and the various test heads 140 is vertically displaceable, i.e. by sliding within bearings 150 and 152 in response to rotation of overhead cam shaft 110 (driven by motor 102). Since cam shaft 110 is driven through the motor 102 which also is in the power train for the various chain drives, it will be evident that an appropriately timed relationship exists between the movement of the closures through the various stations, and the operations performed on the closures at such stations.

Details of the displacement mechanism are best seen by momentarily referring to the web punching and emplacement station 118, from whence it is seen that cam shaft 110 carries a cam 158 rotatable therewith. A similar cam is present for actuating vertical displacement of the assembly at testing station 112; but details are not shown at such station for purposes of simplification. The operation, however, is precisely similar; in particular, rotation of cam shaft 110 rotates cam 158, whereby a cam follower 160, mounted to a crosspiece 162 in turn secured to the members 146 and 148, effects vertically upward or downward movement of the entire test assembly. The said test assembly in particular, drops vertically under the influence of gravity, and is raised vertically by the forces provided through the cam follower 160. The vertical point at which member 162 is secured to members 146 and 148 can be adjusted by set screws (not seen in drawing). This enables vertical adjustment in the final descent point of the assembly, to accommodate for closure of different vertical heights.

Figure 5:
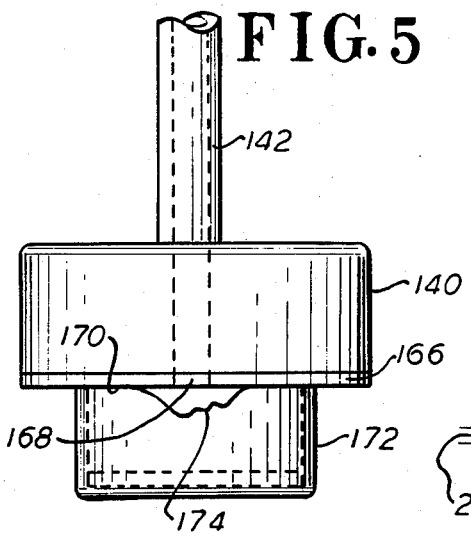
FIG. 5 is a schematic elevational view of a test head at the shell integrity test station, and illustrates the operations effected at that station.

Low pressure air for each of the conduits 142 is provided through input lines 164. These are connected to a suitable manifold, providing low pressure air. The basic testing mechanism is best seen at the schematic view of FIG. 5. The test head 140 is seen to carry at its lower end a thin rubber diaphragm 166, which is provided with a central opening 168. During the test operation the head 140 is lowered to bring diaphragm 166 into contact with the rim 170 of a closure 172 to be tested.

The typical sort of defect which is examined by the present station 112, derives from a so-called "short shot" — which occurs during the molding process for the closure. In particular, an insufficient amount of the then liquid plastic may be provided to the mold, in consequence of which the resultant cap or closure is left in a somewhat incompleted form. Thus, in the present instance, closure 172 is schematically shown as including an incomplete edge portion 174. Where this sort of condition obtains it will be evident that diaphragm 166 does not make a complete seal with the rim 170 of the piece being tested. In consequence, the air pressure within conduit 142 will remain at a relatively low level instead of building to the somewhat higher level which would occur were a complete seal to be provided.

The resultant low pneumatic signal is transmitted back to the electronic and pneumatic control logic 38, where it is appropriately stored in order to enable subsequent rejection of the particular closure having the mentioned defect. Upon completion of the testing process for the group of closures at station 112, the said group is indexed to the following station, i.e. the first rejection station 114; and, at the same time the overhead cam shaft 110, continuing to turn, raises the test assembly, permitting the next successive group of closures to reach test station 114.

The first rejection station 114 is seen to consist of a plurality of rejection heads 178 which are mounted for vertical movement within members 180. The rejection heads may be pneumatically actuated, in which instance members 180 constitute cylinders for pistons moving therewithin; or the heads may simply be actuated by electrical signals, in which instance the various shafts 182 simply represent the actuated portions of solonoids. Connections are not shown for these conventional powering elements.

The mode of operation of rejection station 114 is such that upon the closures reaching the station, the "defect" signals previously provided to logic 38 via line 184 (FIG. 2) enables a "reject" signal through control line 186 to the reject station. This serves to actuate the appropriate rejection head — which moves downwardly to force the closure from the processing stream and onto dead plate 130 which resides below. An opening in dead plate 130 enables the rejected closures to pass onto an underlying rejection chute, where the rejected closures exit from the machine at chute opening 188. The mechanical aspects of the rejection mechanism will be further discussed hereinbelow in connection with FIGS. 10 and 11.

It should, incidentally, be noted, that neither the first rejection station 114, nor a second rejection station 126 subsequently be discussed, are powered through overhead cam shaft 110. In particular, the members 180 are supported directly from the overlying frame elements 154 and 156 by a cross member 190. Thus, it is not contemplated that a moveable yoke-type carrier assembly be present at the rejection stations — as in some of the other stations herein considered.

It should further be noted, that means are provided for adjusting the spacing of guides 132, to accommodate the specific closure sizes moving from station to station in the present application. Thus, in particular, it is seen that a threaded member 192 passes in underlying relationship to dead plate 130. Threaded member 192 is turned by a hand crank 194, which through s uitable linkage adjusts the spacing between securing pieces 196 — which guide the lateral position of guides 132 which are secured thereto.

The closure group proceeding past station 114 now continues to advance along the main processing stream of apparatus 10, and reaches the adhesive-dispensing station 116. As has previously been indicated, this station is, of course, applicable and present where liners are, indeed, to be inserted in closures 14; but the said station would not be present were the present apparatus intended for use in merely inspecting the "linerless" closures. It may also be observed that while most present techniques for liner emplacement utilize adhesives, it is also known to secure liners to the cap interior by other means — such as heat sealing, mechanical deformation or so forth. In this context it should be appreciated that the adhesive-dispensing station may not in all instances be required--even where liners are employed.

Adhesive-dispensing station 116 includes a yoke assembly 198 which is similar to yoke assembly 144 heretofore discussed. In particular, the said yoke assembly 198 depends from a pair of rod members 200, 202 which, as has already been described for station 112, pass through overhead bearings as to enable the assembly 198 to move in a vertical direction (upwardly or downwardly) in accordance with the rotational position of a cam of the type 158 already discussed. The adhesive-dispensing station 116 thus includes a series of four adhesive-dispensing nozzles 204, which are provided a liquid or semi-liquid adhesive material through a series of feed lines 206, which connect to a central reservoir or manifold — not seen in the present drawing.

During operation the closures 14, which have already passed through stations 112 and 114, are indexed to adhesive-dispensing station 116. The yoke assembly 198 thereupon descends, to place the nozzles 204 in proximity to the closure interiors, and a measured quantity of adhesive is dispensed into each closure.

The closures are now indexed to the next successive station in apparatus 10, i.e. to a web punching and liner emplacement station 118.

At station 118 two functions are brought about: Firstly, the web 208, which constitutes the liner material, is fed into the station from a supply reel 210 positioned to one side of the main frame 12 of apparatus 10. The web 208 is appropriately punched to produce circular seals, which seals are then emplaced by the mechanism to be discussed, into the interior of the caps or closures--as to be brought into contact with the adhesive already deposited therein. It may be observed here that the operation of apparatus 10 as herein described is especially set forth for the most common type of closure, i.e. one with circular geometry. It will, however, be appreciated throughout that with suitable modification the present device is quite suitable for processing of caps having other geometries — such as square.

The web supply reel 210 at station 118 is mounted on an assembly 209, which includes an undercarriage 212 provided with rollers 214 which enable ready movement thereof on the underlying floor. A member 216 extends from undercarriage 212 and is secured to the main frame 12 as to define a vertical axis about which undercarriage 212 can be pivoted, i.e. along an arc indicated by arrow 218. The feed rollers 106 and 108 which feed the web to station 118 rotate with the web feeding assembly, i.e. about the same vertical axis. Once the web feeding assembly 209 reaches a particular angular orientation, it may be retained at that position by tightening fasteners (not shown) so that further rotation about the vertical axis does not occur.

In general, it will be seen that web 208 is fed into station 118 at a skewed angle, but that the angle of skewing may be varied as desired. The advantage of this arrangement is that the particular pattern of web punching can be adjusted in consequence of the angular orientation of assembly 209, so as to assure a very high utilization rate for the web; thus it will be evident that as the web is fed (in indexed fashion) through station 118, successive rows 220 of holes, i.e. of circular liner portions, will be punched from the web. Depending upon the specific size of the liners to be punched, i.e. upon the diameter of the closures, a given angular orientation of assembly 209 is desirable. This is to say that maximum utilization, i.e. to achieve minimization of waste in the said web, can be secured by arranging the angle of feed of the web in accordance with the size of the liners being punched.

Figure 4:
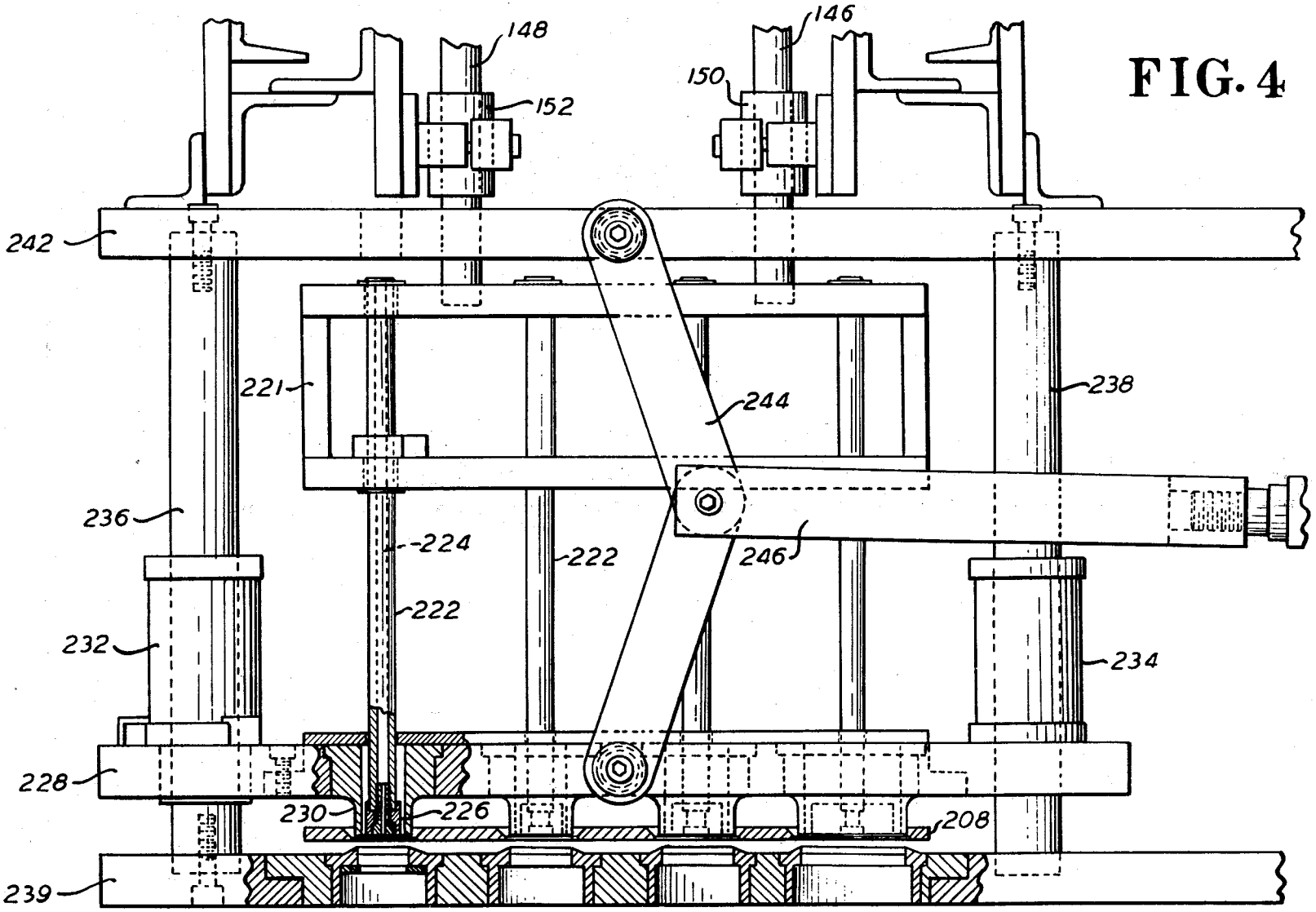
FIG. 4 is an elevational partially cross-sectioned view, taken in the direction 4—4 of FIG. 1, and illustrating details of the lower part of the web punching and liner emplacement station of the apparatus.

The operation of the web punching and liner emplacement station 118 may be best understood by referring both to FIG. 1 and to the partial elevational and cross-sectioned view of FIG. 4. This latter Figure shows the lower portion of the said station in greater detail, so as to better illustrate the manner in which punching, and then emplacement, are sequentially effected. It is thus seen that in response to rotation of cam 158 upon overhead cam shaft 110, the yoke assembly 221 descends in a manner that has been previously discussed. The yoke assembly 221 carries with it a series of members 222 which carry internal passages 224 which are connected to a vacuum manifold (not shown) so that the heads 226 at which members 222 terminate, are capable of drawing a vacuum — thus holding the punched circular liners.

Punch holder plate 228 carries a series of punches 230; the heads 226 pass centrally through the central openings of these punches. Punch holder plate 228 is vertically displaceable by means of die bushings 232 and 234, which enable vertical movement upon the members 236 and 238 which passes between the fixed base piece 239 over which the web 208 passes, and an upper fixed plate 242.

The sequence of operation is as follows: With the closures positioned at station 118, and unpunched web 208 positioned above fixed plate 242, toggle mechanism 244 is displaced by drive link 246, which in turn is driven by a piston and cylinder 248, which may be pneumatically actuated or can also be a solenoid-operated mechanism. Actuation of the latter is again under the control of logic 38. Displacement of link 246 moves punch holder plate 228 downwardly, so that the various punches pass through web 208 and cut out circular liner portions. Thereupon, in consequence of the continued rotation of crankshaft 110, the yoke assembly 221 continues to descend, and the vacuum already mentioned carries the punched-out liners downwardly through fixed base piece 239 and thence into the interior of the underlying closures.

Upon reaching the maximum point of descent, the vacuum within members 222 is removed by control logic 38, and thus the liners are released and held in place by the adhesive material already deposited in the closure interiors.

Following receipt of the liners into closures 14, the said closures are advanced to a tamping station 120, at which a tamping operation is instituted. In particular, this station includes a further yoke assembly 250 and a series of rod-like tamping members 252, which progress into the interior of the caps upon yoke assembly 250 descending in consequence of its control by an overhead cam, i.e. by the same precise type of arrangement as has been discussed, e.g. in connection with reject station 114. The descending members 252 act to tamp the liners against the adhesive, and thereby enable a firm adherence of the liners within the cap or closure interiors.

Tamping station 120 may not be required in all instances. This, of course, is clearly so where liners are not used in the closures; but in addition tamping may not be necessary where certain types of mechanical affixation is used for liner attachment, or where heat sealing or the like is used to secure liners to the closures.

Figure 6:
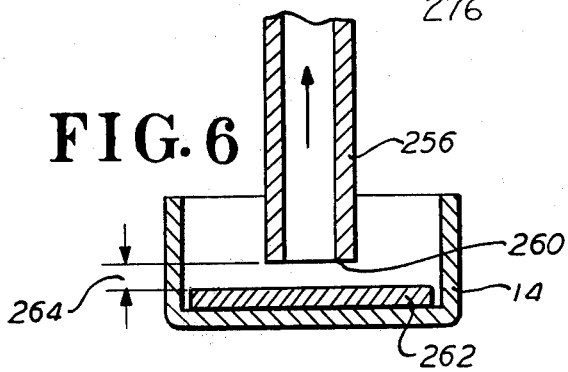
FIG. 6 is a schematic view similar to FIG. 5, and illustrating operation of the testing elements at the loose liner detection and removal station.

The closures next are indexed to a loose-liner inspection and removal station 122. At this station, a yoke assembly 254, similar to those already discussed, and able to move in consequence of similar arrangements, descends so as to emplace the test heads 256 within the interior of the closures. A schematic depiction of the mode of operation of the test then conducted appears at FIG. 6. In particular, each of the test heads 256 is hollow and provided with a low level vacuum via lines 258 from a manifold. The arrangement is such that the end or tips 260 of each head 256 do not quite reach the liner 262 within the closure 14; rather a spacing 264 of the order of 1/16th of an inch or so remains. If the liner is not properly emplaced, i.e. if for some reason is loose — perhaps in consequence of insufficient adhesion or so forth — it will be clear that the liner 262 will rise the small distance of spacing 264 and will thus be held by the tip 260.

The yoke assembly 254 then ascends, carrying liners 262 which may have been removed in consequence of the foregoing operation. A catch plate 266 is pivotedly mounted as to then drop directly beneath the tips 260; and upon the vacuum being extinguished, the liners thus removed will drop into the said catch plate — removing them from further possible interaction in the processing of the closures.

Removing liners which are thus improperly secured has a number of significant advantages. Among these is the fact that the cap or closure from which the liner has been removed will subsequently be detected and rejected and discharged from the machine. The removal of the liner can be significant here since the rejected closure may in some instances be thereupon re-used by grinding same for re-cycling. Were the liner to remain with the rejected closure, it could interfere with this re-cycling process.

In addition removal of loose liners is significant since at the ensuing station 124 a sealing test is performed; and were a liner present (even though "loose"), the sealing test might indicate a satisfactory condition, even though such conclusion would in fact be unwarranted.

At the next station, namely, sealing testing station 124, a direct test is thus effected of the sealing characteristics of closures which have thus far progressed through the machine successfully. In a gross sense, the overall movement of test heads 268 is similar to the operations previously discussed, i.e. a yoke assembly 270 is provided through which conduits 272 pass, which are connected to the said test heads. Low pressure air is provided to the interior of conduits 272 via lines 274 from a central manifold.

Figure 7:
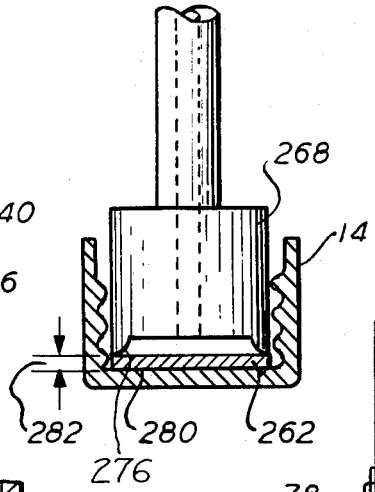
FIG. 7 is a further schematic elevational view; in this instance illustrating the manner in which the operative test elements interact with a closure at the closure seal test station portion of the present apparatus.

The nature of the test heads 260 may be better understood by reference to the schematic cross-sectional view of FIG. 7, from which it is seen that the inspection head 268 is basically formed so as to simulate the container top or bottle top or so forth with which a closure 14 will ultimately be associated. The basic operation thus instituted at station 124 is one of simulating the sealing operation at a container or bottle and determining whether the seal is, in fact, satisfactory; or whether defects are present including cracks, liners missing, or so forth. In FIG. 7, it will be seen that the rim 276 of the inspection head does, in fact, engage a liner 262 "properly" seated in closure 14; and, in consequence, a reject signal is not developed. The inspection head 262 actually descends to a level slightly above the interior surface 280 of the closure (i.e. it stops at a distance 282 above surface 280) whereby if the liner is missing, i.e. in consequence of failure to be properly emplaced, or as a result of a removal at station 122, a pressure defect signal will be generated, and as suggested in FIG. 2, provided to control logic 38 via line 284. In consequence logic 38 stores such information to enable subsequent rejection of that closure.

The caps or closures thereupon are passed to a second or final rejection station 126, which functions precisely in the fashion that has been discussed in connection with the first rejection station 114. In particular, and in consequence of the defect signals provided from the preceding station 124, reject signals may be provided to station 126 via line 286 from logic 38 to enable the individual reject heads 268 to perform their function.

Figure 10:
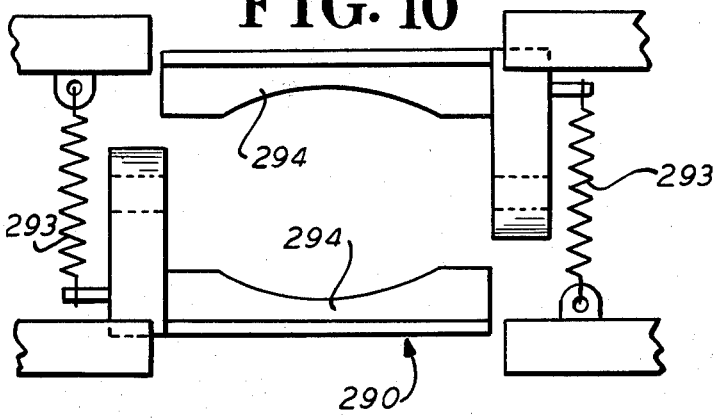
FIG. 10 is a top plan view of the rejection gate utilized in the present apparatus.
Figure 11:
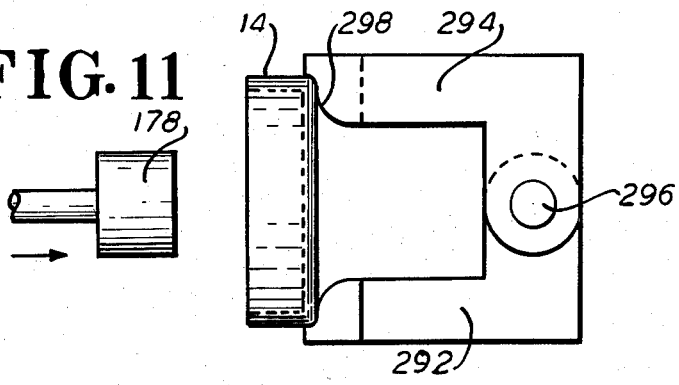
FIG. 11 is a side elevational view of the gate of FIG. 10.

The actual rejection mechanism at station 126 is identical to that at station 114. Details of such mechanism are seen partially in FIG. 1, and also in the detail top plan and side views of FIGS. 10 and 11 (illustrating operation of the rejection gates). In particular, the rejection heads 178 which are actuated by reject signals, descend against the interiors of the associated closures 14. The closures at this point are nested within rejection gates 290, each consisting of a front gate 292 and a rear gate 294 which re spring-biased toward closing by springs 293 and pivotable away from each other by being mounted on an axis 296. As best seen in FIGS. 10 and 11, the gates carry curved cam surfaces 298 such that downward pressure on the closure 14 (by head 178) will force the gates 290 open against the biasing springs 293, thereby permitting the rejected closures to fall through the gate, and an opening in the underlying dead plate 130, and onto a rejection chute. The said chute is not shown at station 126, but is similar to that discussed in connection with station 114.

Those caps or closures which have passed all of the foregoing tests, i.e. have not been rejected, are next indexed to the end of the machine, where such closure proceed from the guides 132 and directly onto a discharge conveyor 300. The accepted closures then pass down the discharge conveyor, and gate deflector means 304 may be provided to direct discharge to various points for further processing or so forth. Typically gate deflector 304 may e.g. be actuated by a solenoid 306 to deflect closure flow into channels 308 or 310 upon the light source — photocell pair 312, 314 indicating to a suitable counter circuit that a given number of closures have passed thereby.

Figure 9:
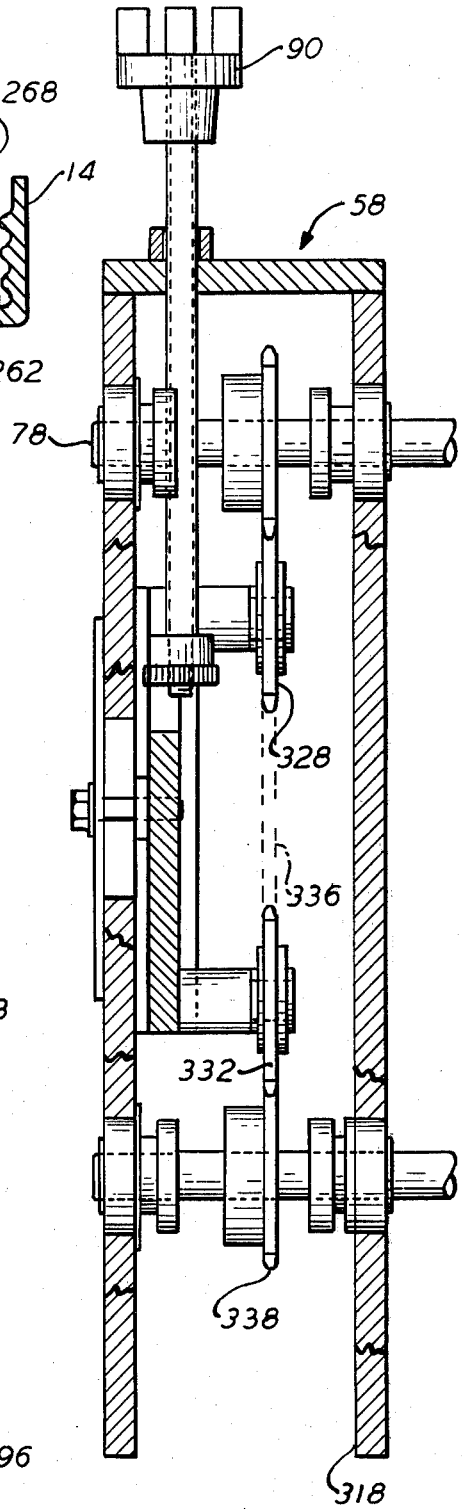
FIG. 9 is a cross-sectional view of the FIG. 8 device, taken along the line 9—9 therein.
Figure 8:
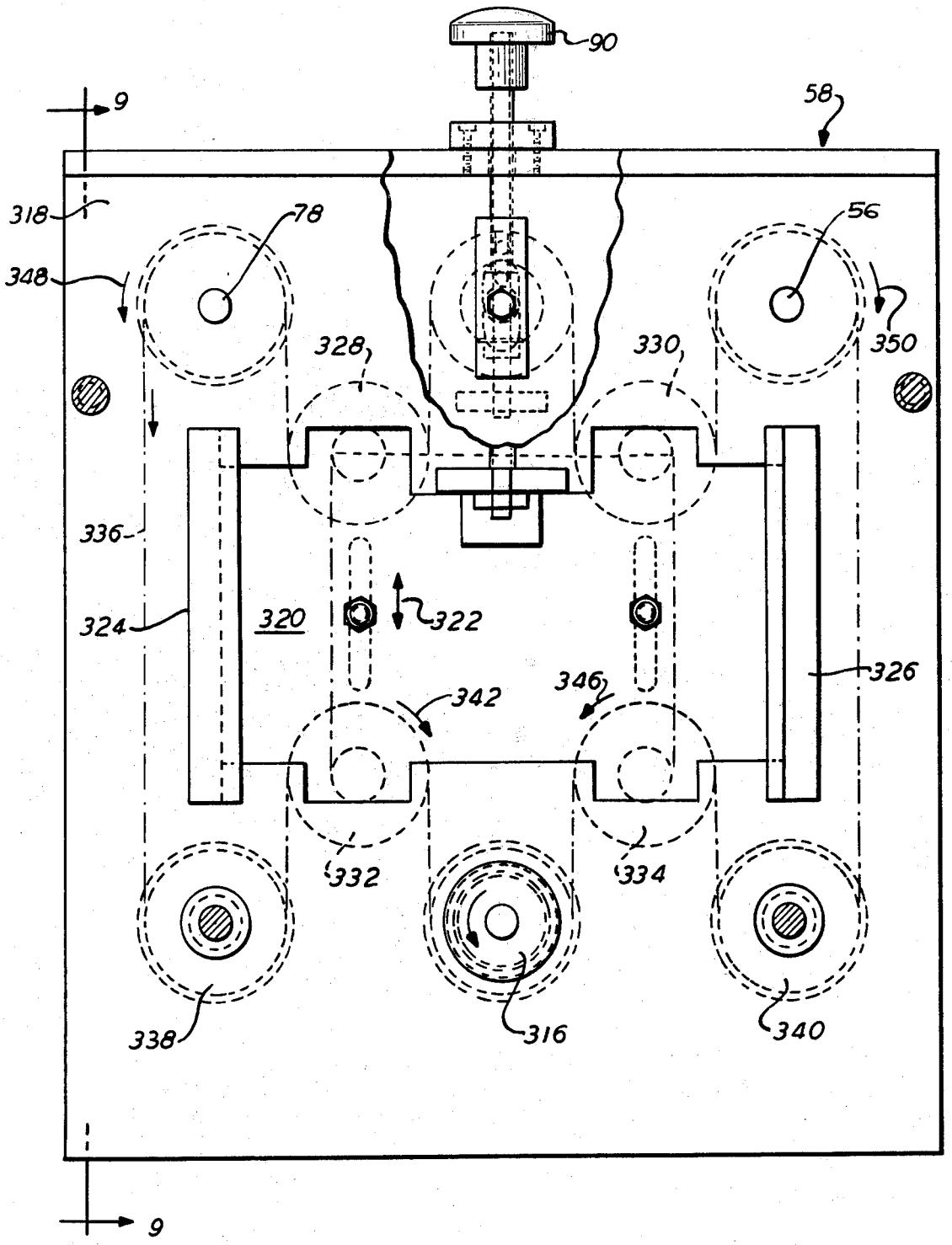
FIG. 8 is an elevational plan view (with cover removed) of the phase adjuster means utilized in the present apparatus.

Side and plan elevational views of the phase adjuster means 58 of FIG. 1 appear in FIGS. 8 and 9 herein. As has already been discussed, the function of means 58 is one of enabling completely accurate adjustment in spacing between the pairs of conveyor bars, such as bars **50*a* and 50*b* to accommodate differing sizes of closures. What is required to enable this result is the ability to displace the carrier chains 52 and 54 with respect to carrier chains 80 and 82 so that the pairs of conveyor bars 50*a* and 50*b* are moved away from a centerline between the two a precise distance, i.e. each of the bars 50*a* and 50*b* moves an equal (and opposite) distance from the said centerline in consequence of the carrier chain adjustment. In turn, what this necessitates from a mechanical viewpoint, is precisely equal but opposite angular adjustments in the two output shafts 56 and 78 from the phase adjuster means 58**.

The manner in which this is accomplished may be appreciated by referring to the aforementioned FIGS. 8 and 9. In this Figure the input power shaft 316 from the indexing motor, i.e. intermittent drive means 104 is seen to pass through the casing 318. A moveable plate 320 is centrally mounted in the case, and the vertical position of the plate may be adjusted upwardly or downwardly, i.e. in the direction of arrow 322 by means of the manual control means 90 already discussed. The plate 320 is displaced upwardly or downwardly within the gibs 324 and 326. The said plate carries a series of four idlers 328, 330, 332 and 334. It is seen that a continuous drive chain 336 passes about the two output shafts 56 and 78, about the pair of idlers 328 and 330 on plate 320 between the two said shafts; and also proceeds downwardly from shafts 56 and 78 to fixed idlers 338 and 340 toward the bottom of casing 318, thence over further idlers 332 and 334 at the bottom of plate 320, and then passes about the input shaft 316 where a suitable sprocket is mounted.

By considering the foregoing device, it will be clear that should, for example, the plate 320 be displaced in an upward direction, i.e. by turning of manual control 90 in a suitable direction, the idlers 328 and 330, and 332 and 334, will rotate in opposite angular directions as are indicated by the arrows 342 and 346, and the overall action of the adjustment will be such as to cause precisely equal but opposite angular changes for the drive shafts 56 and 78 in the directions of arrows 348 and 350, i.e. the precise same adjustment (in opposite directions) will be achieved at each of the drive shafts 56 and 78.

While the present invention has been particularly described in terms of specific embodiments thereof, it will be understood in view of the instant disclosure that numerous variations upon the invention are now enabled to those skilled in the art, which variations yet reside within the scope of the present invention.

For example, additional or other testing stations can be provided in the initial apparatus, for examining or ascertaining other characteristics of interest in the closures — such as presence of undesired flashing (from molding defects), adequacy of threading, presence of lugs, etc. In all these instances test heads of appropriate design are secured to a vertically displaceable yoke assembly, such as yoke 144 at station 112, and the assembly is lowered onto the closures upon same reaching the test station. Thereupon the desired tests are effected, and reject signals generated in accordance with the test results — which signals enable closure rejection at rejection stations of the type discussed herein.

Accordingly, the invention is to be broadly construed and limited only by the scope and spirit of the claims now appended hereto.

We claim:

1. Apparatus for lining and testing container closures comprising in combination:

means for forming an infeed stream of said closures;

means interacting with closure stream for forming groups of closures;

conveyor means for accepting said closure groups and conveying said groups through said apparatus as a plurality of parallel moving processing lines of closures;

shell integrity test station means in said processing lines for testing the shell integrity of said closures;

first rejection station means for displacing from said processing lines closures determined to be defective at said shell integrity testing station;

seal emplacement station means downstream from said first rejection station means, for emplacing seals in closures proceeding thereto from said rejection station;

sealing testing station means downstream from said seal emplacement station means for testing the sealing characteristics of closures proceeding thereto;

second rejection station means downstream of said sealing testing station means, for rejecting closures determined to be defective at said sealing testing station means; and discharge station means downstream of said second rejection station means, for receiving closures successfully proceeding past said second rejection station means.

2. Apparatus in accordance with claim 1, further including loose liner detector and removal station means downstream of said seal emplacement station means, for detecting and removing loose liners from said closures.

3. Apparatus in accordance with claim 2, further including adhesive applicator station means upstream of said seal emplacement station and downstream of said first rejection station, for providing adhesive to the interior of closures proceeding thereto to promote adherence of said seals.

4. Apparatus in accordance with claim 3, further including tamping station means downstream of said seal emplacement station and upstream of said sealing testing station means, for tamping said emplaced seals within the interiors of closures proceeding thereto, to promote bonding of same to said closure interiors.

5. Apparatus in accordance with claim 1, wherein said seal emplacement station includes means for feeding a web of the material constituting said seals into the said station, means for punching said web to form said seals, and means for emplacing said punched seals within said closure interiors.

6. Apparatus in accordance with claim 5, wherein said means for feeding said web includes means for supporting a roll of said web material, and means for advancing said web into said seal emplacement station.

7. Apparatus in accordance with claim 6, wherein said support means for said web roll comprises a carriage positioned to one side of said seal emplacement station, said carriage being swivelable on an arc about said station to enable adjustment of the infeed direction of said web into said station, thereby to enable adjustment of the punched patterns at said web, in accordance with the size of said punched seals to thereby enable maximization of web utilization.

8. Apparatus in accordance with claim 1, wherein said conveyor means comprises first and second flights of carrier bars, the bars of said first flight being displaced from the bars of said second flight to accommodate said closures therebetween; and means to advance both said flights in indexed fashion from station to station of said apparatus, thereby to convey said closures through said stations.

9. Apparatus in accordance with claim 8, further including means to adjust the said spacing between said bars of said first flight and said bars of said second flight, to enable conveyance of closures of different sizes.

10. Apparatus in accordance with claim 1, wherein said means interacting with said closure stream for forming said group of closures comprises pin means positioned to periodically interrupt said infeed stream to break up said stream into said groups.

11. Apparatus for testing container closures, comprising in combination:

means for forming groups of said closures and conveying said groups through said apparatus as a plurality of parallel-moving processing lines of closures;

shell integrity test station means in said processing lines for testing the shell integrity of said closures;

sealing testing station means in said processing lines for testing the sealing characteristics of closures preceding thereto;

rejection station means for rejecting from said processing lines, closures determined to be defective at said shell integrity test station means or at said sealing testing station means; and discharge station means for receiving from said processing lines closures not rejected in consequence of the said tests at said shell integrity test station means and at said sealing testing station means.

12. Apparatus in accordance with claim 11, including means for moving said groups of closures in indexed fashion among said stations.

13. Apparatus in accordance with claim 11, including separate rejection station means respectively downstream of said shell integrity test station means and of said sealing testing station means; and control means responsive to said shell integrity test station means and said sealing testing station means, for actuating the rejection station means downstream of said respective station upon a closure being found defective by said associated test station means.

14. Apparatus in accordance with claim 11, wherein said shell integrity test station means includes a plurality of test heads, means to bring said test heads into engagement with the rims of said closures, and means responsive to inadequate sealing condition between said rims and test heads for generating defect signals for actuation of said associated rejection station means.

15. Apparatus in accordance with claim 13, wherein said sealing testing station means comprises a plurality of test heads, said test heads being formed to simulate the container surface with which said closure seals; means to bring said plurality of test heads into contact with the interior of said closures to simulate a sealing relationship therewith; means to provide a pressure condition within said test heads; means to determine the variations in said applied pressure in consequence of imperfect sealing with said closures; and means responsive to the generation of an imperfect seal, for providing a rejection signal to said associated rejection station for rejecting the said closure found to be defective.

16. Apparatus in accordance with claim 12, wherein said rejection station means comprises a plurality of individually displaceable rejection heads; and means for individually actuating said heads in accordance with the presence of rejection signals deriving from said associated testing station, for thereby displacing from said processing line the said closures found to be defective.

17. Apparatus in accordance with claim 1, wherein said conveyor means moves said groups in indexed fashion to said stations.

18. Apparatus in accordance with claim 17, wherein each said test station means comprises a plurality of testing heads for testing said closures; a carrier means for said test heads, said carrier means being mounted in overhead relationship to said processing lines; means for vertically displacing said carrier means together with said test heads, for bringing said heads into testing relationship with said closures upon said closures being positioned at said respective stations, and for upwardly displacing said carrier away from said closures upon completion of said testing.

19. Apparatus in accordance with claim 18, including cam shaft means mounted overhead with respect to said processing lines; means for rotating said cam shaft means in timed relationship to the indexed conveyance of said closures; and cam follower means actuated by said cam shaft means and mechanically linked to said carrier members for enabling said upward and downward vertical movement of said carrier members in accordance with the indexed positions of said closure groups.

20. Apparatus for lining with seals and testing container closures, comprising in combination:

means for forming groups of said closures and conveying said groups through said apparatus as a plurality of parallel moving processing lines of closures;

a seal emplacement station positioned at said processing lines, for emplacing seals in said closures; said station including means for feeding a web of the material constituting said seals into said station, means for punching said web to form said seals, and means for emplacing said punched seals within said closure interiors;

sealing testing station means downstream from said seal emplacement station, for testing the sealing characteristics of closures proceeding thereto; and rejection station means downstream of said sealing testing station means, for rejecting closures determined to be defective at said sealing testing station means.

21. Apparatus in accordance with claim 20, wherein said means for feeding said web, includes means for supporting a roll of said web material, and means for advancing said web into said seal emplacement station.

22. Apparatus in accordance with claim 21, wherein said support means for said web roll, comprises a carriage positioned to one side of said seal emplacement station, said carriage being swivelable on an arc about said station to enable adjustment of the infeed direction of said web into said station, thereby to enable adjustment of the punched patterns at said web in accordance with the size of said punched seals, to thereby enable maximization of the utilization of said web.

* * * * *